US007096609B2

(12) United States Patent
Bainter

(10) Patent No.: US 7,096,609 B2
(45) Date of Patent: Aug. 29, 2006

(54) TRENCHER UNIT

(76) Inventor: Wesley Allen Bainter, P.O. Box 705, Hoxie, KS (US) 67740

( * ) Notice: Subject to any disclaimer, the term of this patent is extended or adjusted under 35 U.S.C. 154(b) by 275 days.

(21) Appl. No.: 10/771,800

(22) Filed: Feb. 4, 2004

(65) Prior Publication Data

US 2004/0172865 A1 Sep. 9, 2004

Related U.S. Application Data

(63) Continuation-in-part of application No. 10/728,623, filed on Jan. 30, 2004.

(60) Provisional application No. 60/444,839, filed on Feb. 4, 2003.

(51) Int. Cl.
*E02F 3/28* (2006.01)

(52) U.S. Cl. ..... 37/352; 37/357; 37/360; 37/464

(58) Field of Classification Search ..... 37/352, 37/353, 357, 359, 360, 356, 363, 364, 464; 180/235, 418
See application file for complete search history.

(56) References Cited

U.S. PATENT DOCUMENTS

| | | | |
|---|---|---|---|
| 1,769,074 | A | 7/1930 | Rautti |
| 2,748,504 | A | 6/1956 | Mcininch |
| 2,751,698 | A | 6/1956 | Brown |
| 2,783,556 | A | 3/1957 | Burns et al. |
| 2,828,557 | A | 4/1958 | Brown |
| 2,846,786 | A | 8/1958 | Barber et al. |
| 3,380,547 | A | 4/1968 | Granryd |
| 3,388,487 | A | 6/1968 | Schmidt |
| 3,603,010 | A | 9/1971 | Polinek |
| 3,605,903 | A | 9/1971 | Glesmann |
| 3,605,908 | A | 9/1971 | McDonald et al. |
| 3,659,364 | A | 5/1972 | Wilson |
| 3,771,241 | A | 11/1973 | Lindell et al. |
| 4,103,441 | A | 8/1978 | Flippin |
| 4,195,427 | A | 4/1980 | Lanham |
| 4,277,898 | A | 7/1981 | Flippin |
| 4,322,899 | A | 4/1982 | Clune |
| 4,483,084 | A | 11/1984 | Caldwell et al. |
| 4,716,665 | A | 1/1988 | Johnson et al. |
| 4,732,507 | A | 3/1988 | Artzberger |
| 4,750,280 | A | 6/1988 | Dalaine |
| 4,833,797 | A | 5/1989 | Slunecka et al. |
| 4,974,348 | A | 12/1990 | Wallace |

(Continued)

OTHER PUBLICATIONS

International Search Report for PCT/US03/15565, with International Publication No. WO 2003/097946.

(Continued)

*Primary Examiner*—Thomas A Beach
(74) *Attorney, Agent, or Firm*—Robert O. Blinn

(57) ABSTRACT

The trencher unit of the present invention mounts to a standard loader attachment fitting and relies on the auxiliary hydraulic power of a loader. A powered chain drive sprocket is mounted near the upper end of the trencher unit. An idler wheel is mounted at the bottom end of the trencher unit. The chain drive sprocket and the idler wheel carry an endless digging chain which presents a series of digging teeth. The trencher unit includes a vertically adjustable auger assembly having forward and rear augers that push excavated soil away from an excavated trench. A loader operator controlling the position of the trencher unit can lower the digging chain of the trencher unit into a work surface to dig a trench. The trencher unit is typically operating in an upright position so that the loader may be guided along a curved path to dig a curved section of trench.

18 Claims, 9 Drawing Sheets

U.S. PATENT DOCUMENTS

| | | | | |
|---|---|---|---|---|
| 4,987,689 | A * | 1/1991 | Kaczmarski et al. | 37/195 |
| 5,033,214 | A | 7/1991 | Kaczmarski et al. | |
| 5,228,221 | A | 7/1993 | Hillard et al. | |
| 5,964,049 | A | 10/1999 | Dean et al. | |
| 6,249,993 | B1 | 6/2001 | Armstrong et al. | |
| 6,266,900 | B1 | 7/2001 | Bizzell | |
| 6,516,545 | B1 | 2/2003 | Jenkins, Jr. | |
| 6,658,768 | B1 * | 12/2003 | Bainter | 37/352 |
| 6,708,430 | B1 * | 3/2004 | Azure et al. | 37/361 |
| 6,789,336 | B1 * | 9/2004 | Collins et al. | 37/352 |
| 2002/0116844 | A1 | 8/2002 | Collins et al. | |

OTHER PUBLICATIONS

Worksaver Bobcatalog 2003, Winter 2003, BOBCAT/Ingersoll Rand, Fargo, ND. See attachment No. 57 on p. 43, side to side adjustable trencher attachment with auger.

* cited by examiner

TRENCHER UNIT

CROSS REFERENCES TO RELATED APPLICATIONS

This application claims the benefit of U.S. Provisional Patent Application No. 60/444,839 filed Feb. 4, 2003. This application is also a continuation in part of U.S. patent application Ser. No. 10/728,623 having an effective filing date of 30 Jan. 2004.

FIELD OF THE INVENTION

The present invention relates to a trencher unit that can be mounted to a loader such as a skid steer loader.

BACKGROUND OF THE INVENTION

Trenchers typically include a boom mounted endless digging chain having a series of teeth. Typically, the digging chain encircles a motor driven sprocket wheel and an idler wheel which are mounted at opposite ends of a boom type structure or frame. Typically, the frame is tilted into a digging position until it reaches a relatively shallow angle. Generally, the frame that carries the digging chain pivots at its motor driven end to tilt into contact with the ground so that the digging chain can excavate a trench as the trencher moves relative to the ground. Generally, prior art trenchers have been stand alone, self powered units or loader attachment units that operate in a reverse direction at relatively shallow digging angles.

A trencher unit that digs at a shallow angle is not effective for digging the curved trench sections that are often needed during construction projects. What is needed is a trencher unit that can attach to an existing loader such as a common skid steer loader. Moreover, a trencher attachment for loaders is needed that is configured to operate in an upright fashion for digging the curved trenches needed in many construction applications.

BRIEF DESCRIPTIONS OF THE INVENTION

The trencher unit of the present invention is a unit that can be mounted to a standard attachment plate of a loader such as a typical skid steer loader. The trencher unit relies on the auxiliary hydraulic power of a loader and can be operated in an upright orientation to dig curved trench sections. The trencher unit includes a support frame having an attachment fitting at its proximate end for mounting to the attachment plate of a loader. A chain drive sprocket is rotatably mounted to the support frame near the proximate end of the support frame. An idler wheel is mounted to the support frame at the distal end of the support frame. The chain drive sprocket and the idler wheel carry an endless digging chain which presents a series of digging teeth. A hydraulic chain drive motor for driving the chain drive sprocket and the digging chain is mounted to the support frame. Auxiliary hydraulic lines which communicate with the loader hydraulic system supply the hydraulic chain drive motor with pressurized hydraulic fluid. An auger assembly situated on the support frame between the drive sprocket and the idler wheel includes augers for pushing dirt away from the digging chain. The auger assembly is mounted to the support frame in an adjustable fashion such that the auger assembly can be positioned between an upper position and a lower position between to accommodate a corresponding range of trench depths. The auger assembly includes forward and rear auger drive sprockets positioned in front of and behind the digging chain support frame. The auger drive sprockets engage the digging chain and turn the augers as the augers push excavated soil away from the trench. An operator may control the vertical position and orientation of the trencher unit by controlling the position and orientation of the attachment plate of the loader. By lowering the attachment plate of the loader, an operator can lower the digging chain of the trencher unit into an earthen surface in order to dig a trench. When the trencher unit is operating in an upright position, the loader can be turned in order to dig a curved section of trench.

DETAILED DESCRIPTION

Figure 1:
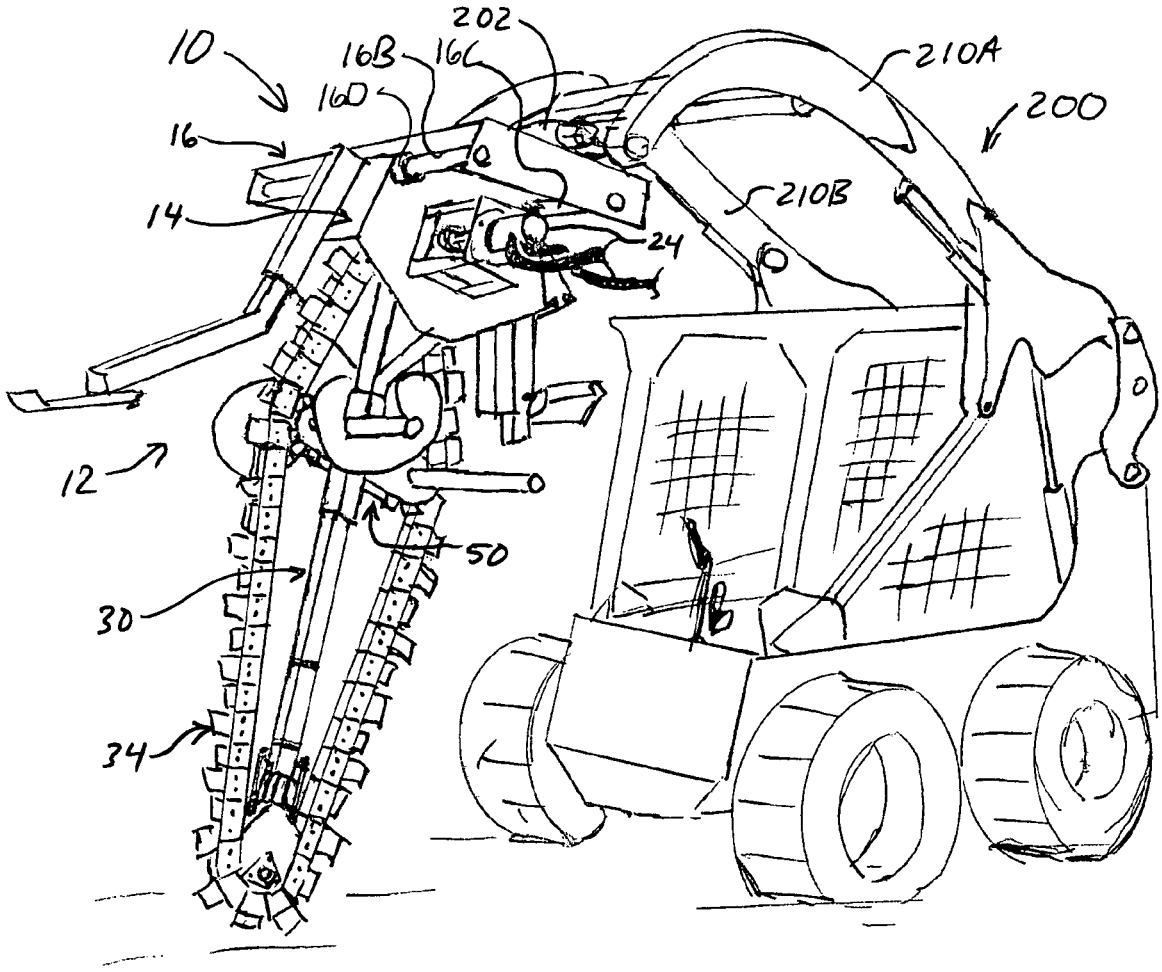
FIG. 1 is a perspective view of the trencher unit, in the upright position, mounted to a loader shown with the rear augers of the auger assembly removed for clarity.

Referring to the drawings, FIG. 1 illustrates a trencher unit 10 in accordance with an embodiment of the present invention. Trencher unit 10, shown in FIG. 1 is mounted to an attachment fitting 202 of a loader 200. Loader 200 is shown in FIG. 1 for illustrative purposes. Loader 200 is preferably a motorized loader vehicle having an attachment fitting for receiving attachments, sufficient power for lifting and rotating an attachment and preferably an auxiliary hydraulic power supply for driving an attachment requiring hydraulic power. Preferably, loader 200 is hydraulically powered to raise and lower loader arms 210A and 210B as well as tilt attachment fitting 202.

Figure 2:
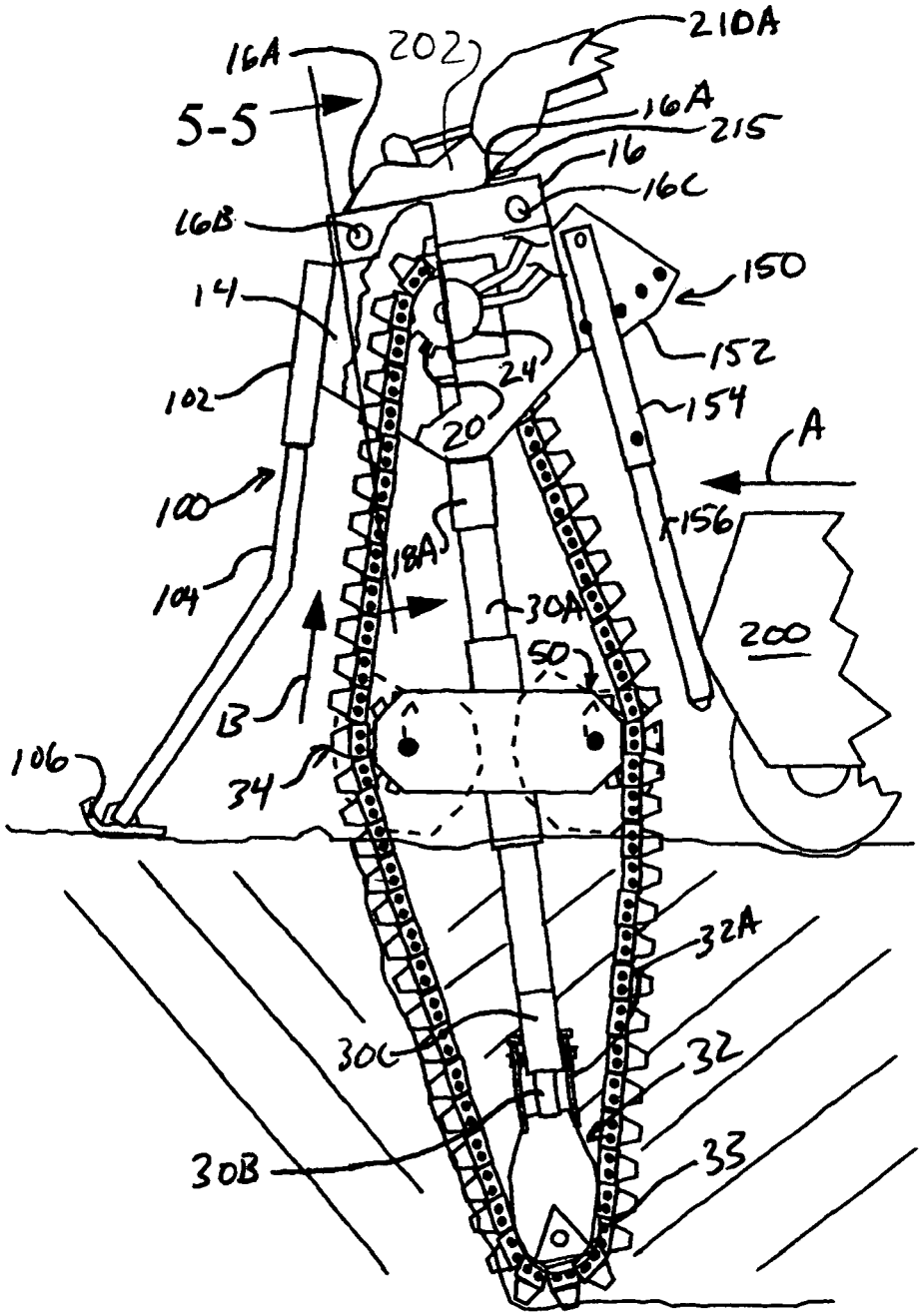
FIG. 2 is a right side view of the trencher unit with the trencher unit housing partially cut away and showing the trencher unit as it digs a trench in a standard forward moving fashion.

FIGS. 1 and 2 show trencher unit 10 in accordance with an embodiment of the present invention. Trencher unit 10, as shown in FIG. 1, has a support frame 12 which includes a housing 14 and a digging chain support assembly 30. Digging chain support assembly 30 carries an auger assembly 50 and an endless digging chain 34. Housing 14 also supports a hydraulic drive motor 24 for driving digging chain 34. Housing 14 is adjustably mounted for side to side adjustment to an attachment assembly 16. Attachment assembly 16 preferably includes a standard attachment fitting for mounting to attachment fitting 202 of loader 200.

FIG. 2 provides a partially cut away side view of trencher unit 10 in accordance with an embodiment of the present invention. Direction arrow A in FIG. 2 is intended to indicate the direction of travel of loader 200 and trencher unit 10 as a trench is being dug in a forward direction. The wheels of loader 200 are widely spaced and therefore avoid the excavated portion of the trench. Direction arrow B indicates the direction of travel of digging chain 34. Digging chain 34 will be described in greater detail below.

As can be seen in FIG. 2, a skid plate assembly 100 extends from the front of housing 14. The purpose of skid plate assembly 100 is to limit the forward pitching movement of trencher unit 10. Skid plate assembly 100 includes a skid arm mount 102 which adjustably carries a skid arm 104. Pivotably mounted to the lower end of skid arm 104 is a skid plate 106 which is designed to slide upon a work surface forward of the excavated portion of a trench. Preferably, the position of skid plate 106 is adjusted and set to generally coincide with the lower portions of the augers of auger assembly 50.

Extending behind housing 14 is an adjustable brace assembly 150. Adjustable brace assembly 150 communicates between trencher unit 10 and loader 200 to limit movement of trencher unit 10 toward loader 200. Adjustable brace assembly 150 includes a brace mount 152 which is fixed to housing 14. Pivotably and adjustably mounted to brace mount 152 is a brace sleeve 154 which carries a brace arm 156 in an adjustable, telescoping fashion. As can be seen in FIG. 2, brace sleeve 154 may be pinned to an angular position relative to brace mount 152 and brace arm 156 may be extended and pinned to a selected extended position relative to brace sleeve 154 to provide a brace against loader 200. Preferably, the pins for pinning the position of brace arm 156 are position such that they can be reached by an operator seated within loader 200.

Figure 5A:
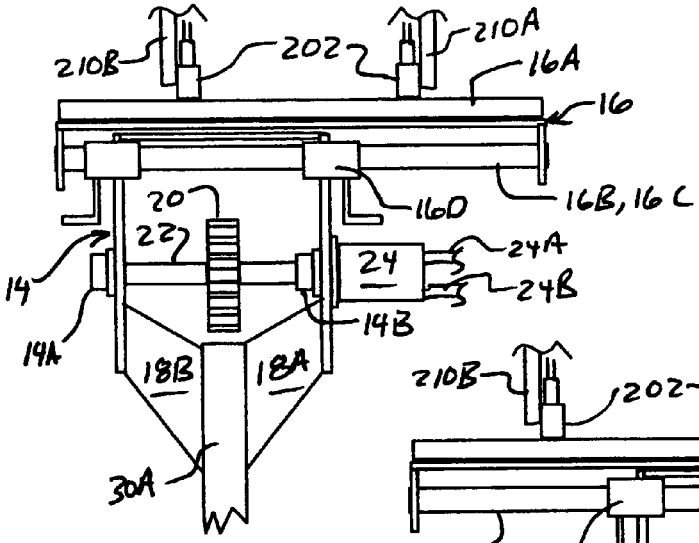
FIG. 5A is a cross section view taken from plane 5—5 in FIG. 2 showing the upper part of the trencher unit with the housing mounted to the left side of the attachment fitting.
Figure 5B:
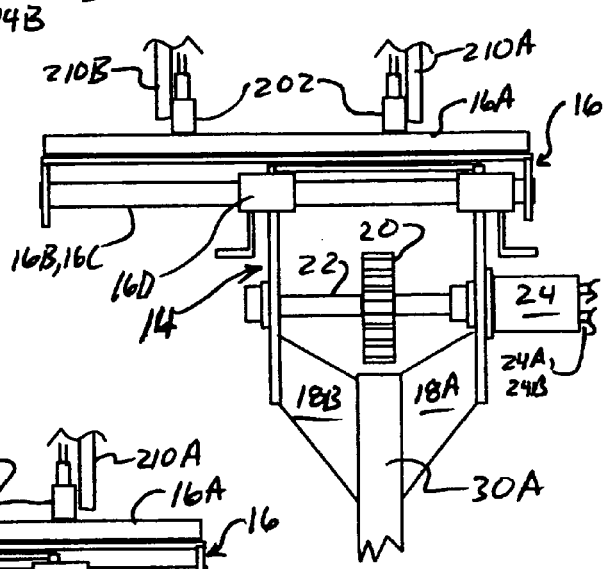
FIG. 5B is a cross section view taken from plane 5—5 in FIG. 2 showing the upper part of the trencher unit with the housing mounted to the right side of the attachment fitting.
Figure 5C:
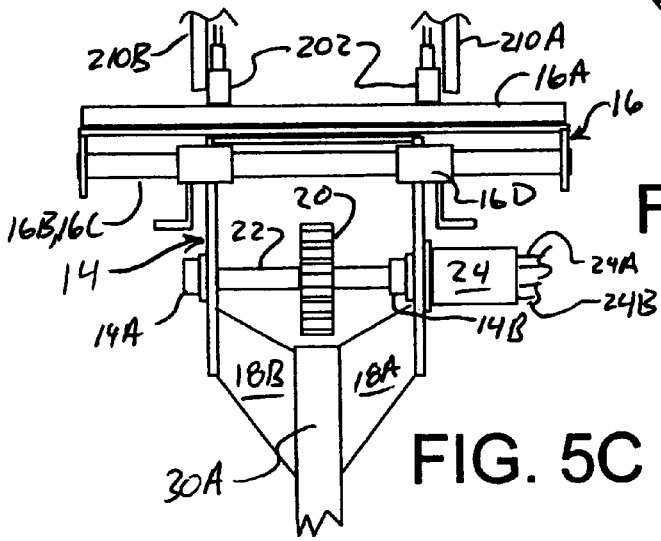
FIG. 5C is a cross section view taken from plane 5—5 in FIG. 2 showing the upper part of the trencher unit with the housing mounted at the center of the attachment fitting.

Housing 14 is best understood with reference to FIG. 2 and FIGS. 5A–5C. Housing 14 is adjustably mounted for side to side adjustment to attachment assembly 16. Attachment assembly 16 includes a standard attachment provisions 16A for engaging attachment fitting 202 of loader 200. Attachment fitting 202 of loader 200 includes a standard clamping mechanism of a type that is well known in the art including a cam actuated pin 215 which engages a corresponding opening in attachment provisions 16A thereby locking attachment fitting 16 of trencher unit 10 to attachment fitting 202 of loader 200. Mounted within attachment assembly 16 are two transverse members 16B and 16C. Housing 14 is adjustably mounted to transverse members 16B and 16C by a set of clamping collars 16D. As can be seen in FIGS. 5A–5C, housing 14 may be adjusted between a left side position as shown in FIG. 5A and a right side position shown in FIG. 5C.

The details of digging chain support assembly 30 are best understood with reference to FIGS. 2, 3, 3A–3D and 5A–5C. Digging chain support assembly 30 includes a sleeve member 30A which is fixed to housing 14 by structural supports 18A and 18B. As can be best seen in FIGS. 5A–5C, structural supports 18A and 18B extend from the sides of housing 14 and rigidly mount sleeve member 30A of chain support assembly 30 to housing 14. A chain drive sprocket 20 is carried on a drive shaft 22. As can be best seen in FIGS. 5A–5C drive shaft 22 is mounted by bearings 14A and 14B to housing 14. Also mounted to housing 14 and mechanically coupled to drive shaft 22 is a reversible chain drive motor 24, which, in this embodiment, is a reversible hydraulic motor supplied by lines 24A and 24B connected to the auxiliary hydraulic power supply of loader 200. At the lower end of chain support assembly 30 is an idler wheel assembly 32 including a rotatably mounted idler wheel 33. The position of idler wheel assembly 32 can be adjusted to take up slack in digging chain 34 by turning a pair of threaded adjustment rods 32A. Threaded adjustment rods 32A provide an adjustment mechanism for pushing telescoping support member 30B, idler wheel assembly 32 and thus idler wheel 33 away from sleeve member 30A and chain drive sprocket 20. Digging chain 34 loops around chain drive sprocket 20 at the upper end of support frame 12 and around idler wheel 33 at the lower end of digging chain support assembly 30. Auger assembly 50 is adjustably positioned upon support assembly 30 between housing 14 and idler wheel assembly 32. Auger assembly 50 includes two shaft mounted sprockets for engaging digging chain 34 and turning augers for pushing excavated dirt away from an excavated portion of a trench. Auger assembly 50 will be described in greater detail below.

Figure 3:
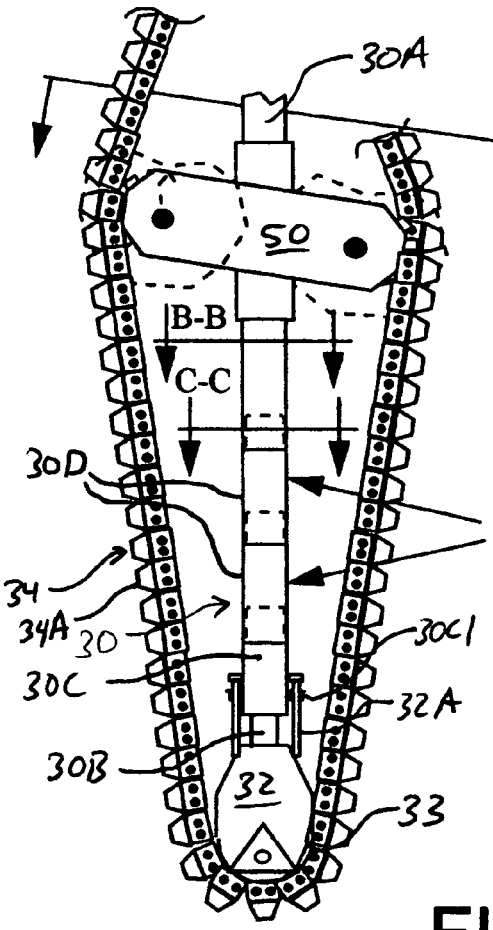
FIG. 3 is a side view of the lower portion of the trencher unit showing the installation of extension members.
Figure 3A:
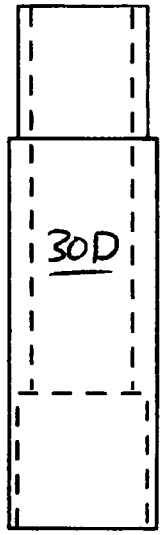
FIG. 3A is an enlarged detail side view of an extension member for extending the chain support member.
Figure 3B:
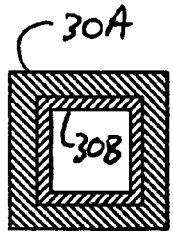
FIG. 3B is an enlarged detail cross section end view of the chain support assembly.

FIGS. 3, 3A and 3B further illustrate the lower, distal portions of digging chain 34 and digging chain support assembly 30. As can be seen in FIG. 3, digging chain support assembly 30 includes a sleeve member 30A. As can be seen in FIGS. 2, and 5A–5C support sleeve 30A is mounted at its upper end to housing 14 by supports 18A and 18B. Sleeve member 30A receives a telescoping support member 30B. In FIG. 2, telescoping support member 30B is shown extending through support sleeve 30A substantially to the upper end of sleeve member 30A. Idler wheel assembly 32 is mounted to the lower end of telescoping support member 30B. Idler wheel assembly 32 includes a plate like idler wheel 33. The thickness of idler wheel 33 is sized such that idler wheel 33 is received between the opposite plates of digging chain links 34A shown in FIG. 3D. As can be best seen in FIG. 3B, sleeve member 30A has a central passage adapted for receiving telescoping member 30B. The lower end of sleeve member 30A is also fashioned to receive an end member 30C. End member 30C also has a central passage adapted for receiving telescoping member 30B which aligns with the central passage of sleeve member 30A. End member 30C also includes threaded brackets 30C1 for receiving bolts 32A. Bolts 32A are for forcing idler wheel assembly 32 and telescoping member 30B away from housing 14 in order to apply tension to digging chain 34.

Figure 3C:
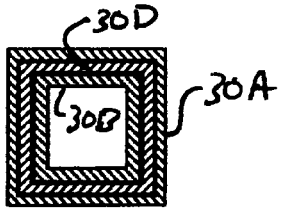
FIG. 3C is an enlarged detail cross section end view of the chain support assembly taken at the joint between the sleeve member and an extending member.

As can be seen by referring to FIG. 3 and FIGS. 3A and 3B, digging chain support assembly 30 may be extended by adding one or more interfitting extension members 30D. Extension member 30D shown in FIG. 3A, is designed to fit into the lower end of sleeve member 30A. As can be seen in FIG. 3A, extension member 30D is shaped at its lower end to receive end member 30B or a second extension member 30D. FIG. 3C shows how extension member 30D, sleeve member 30A and telescoping support member 30B fit together. As is shown in FIG. 3, more than one extension member 30D may be used to increase the length of the digging chain support assembly 30 thus adapting trencher unit 10 for digging a deeper trench. When these adjustments are made, the position of telescoping member 30B and idler wheel assembly 32 may be adjusted between a retracted position as shown in FIG. 2 and an extended position as shown in FIG. 3. When extension members 30D are added, the top end of telescoping support member 30B is located lower with respect to sleeve member 30A. However, regardless of how many extension members 30D are added, it is preferable that telescoping support member 30B overlap with sleeve member 30A to provide adequate structural rigidity. Digging chain 34 includes links that may be unbolted so that additional links may be added to digging chain 34 in order to accommodate the longer assembly resulting from the addition of one or more extension members 30D. The above described method for extending chain support assembly 30 may also be used to increase the relative distance between auger assembly 50 and idler assembly 32 which in effect raises the relative position of auger assembly 50.

Figure 3D:
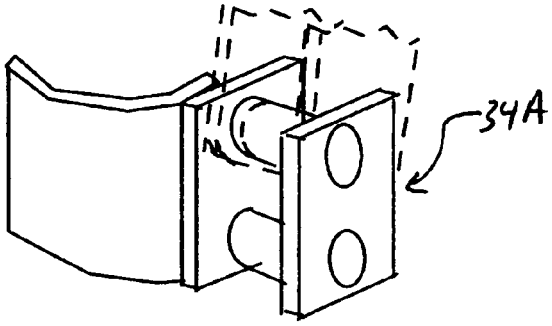
FIG. 3D is a detail isometric view of a link from the digging chain with an example cutting tooth attached and with an interconnecting link shown in phantom.
Figure 3E:
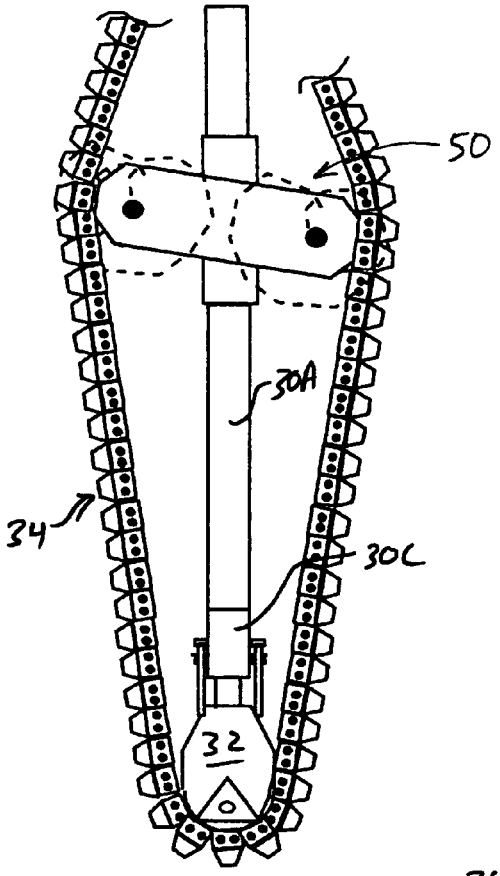
FIG. 3E is a side view of the lower portion of the trencher unit showing the auger assembly adjusted in a first upper position.
Figure 3F:
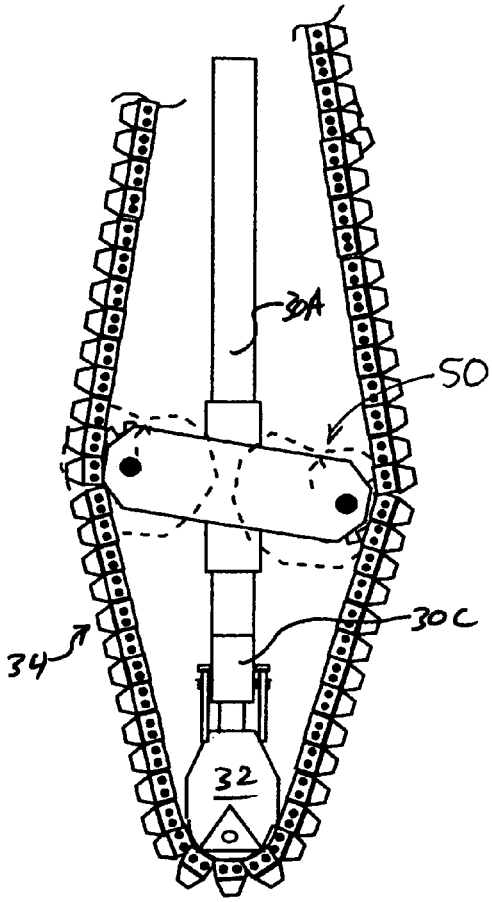
FIG. 3F is a side view of the lower portion of the trencher unit showing the auger assembly adjusted in a second lower position
Figure 4:
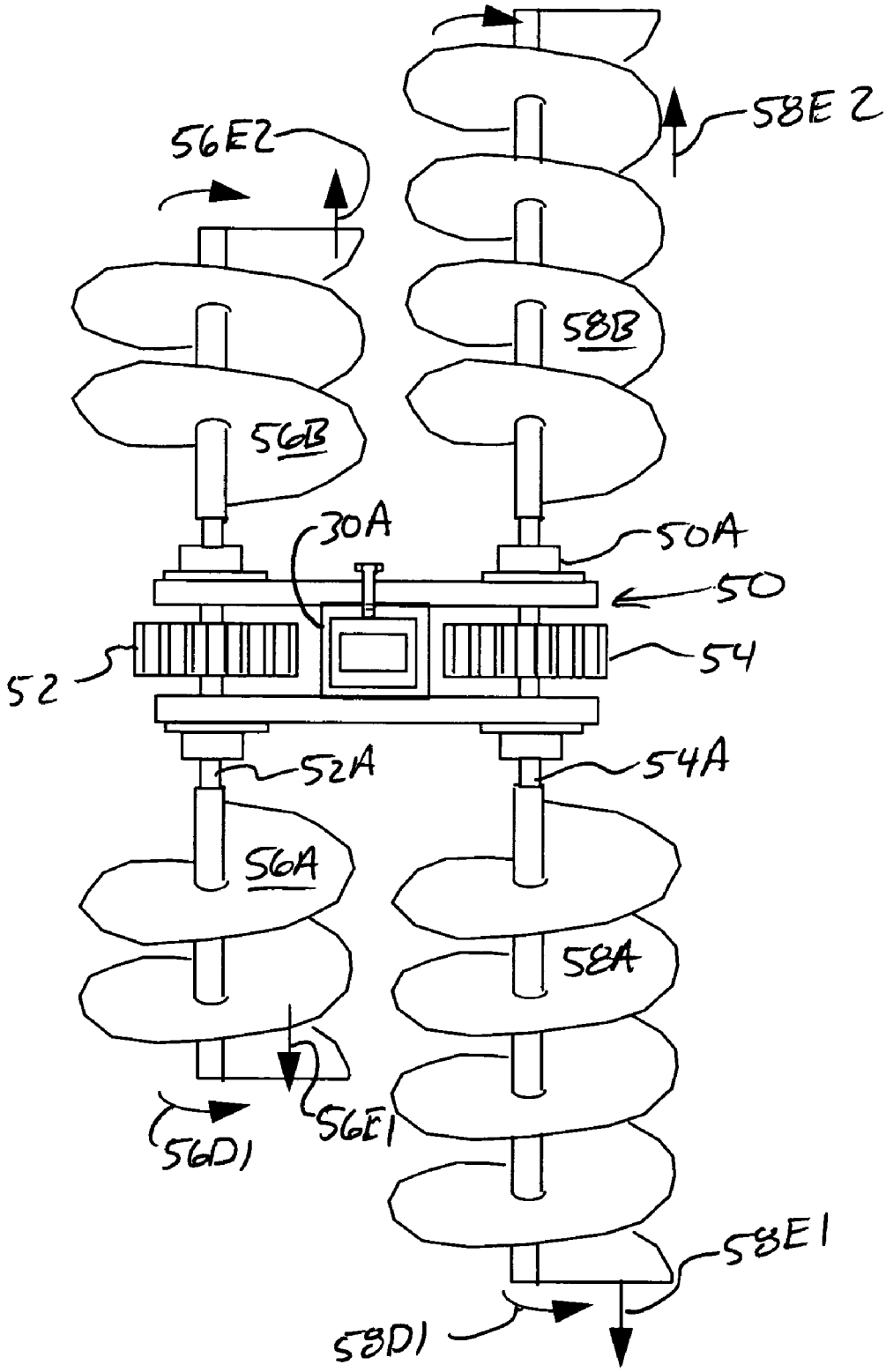
FIG. 4 is a detail top view of the auger assembly taken from plane 4—4 of FIG. 3 shown with the digging chain removed for clarity.
Figure 4A:
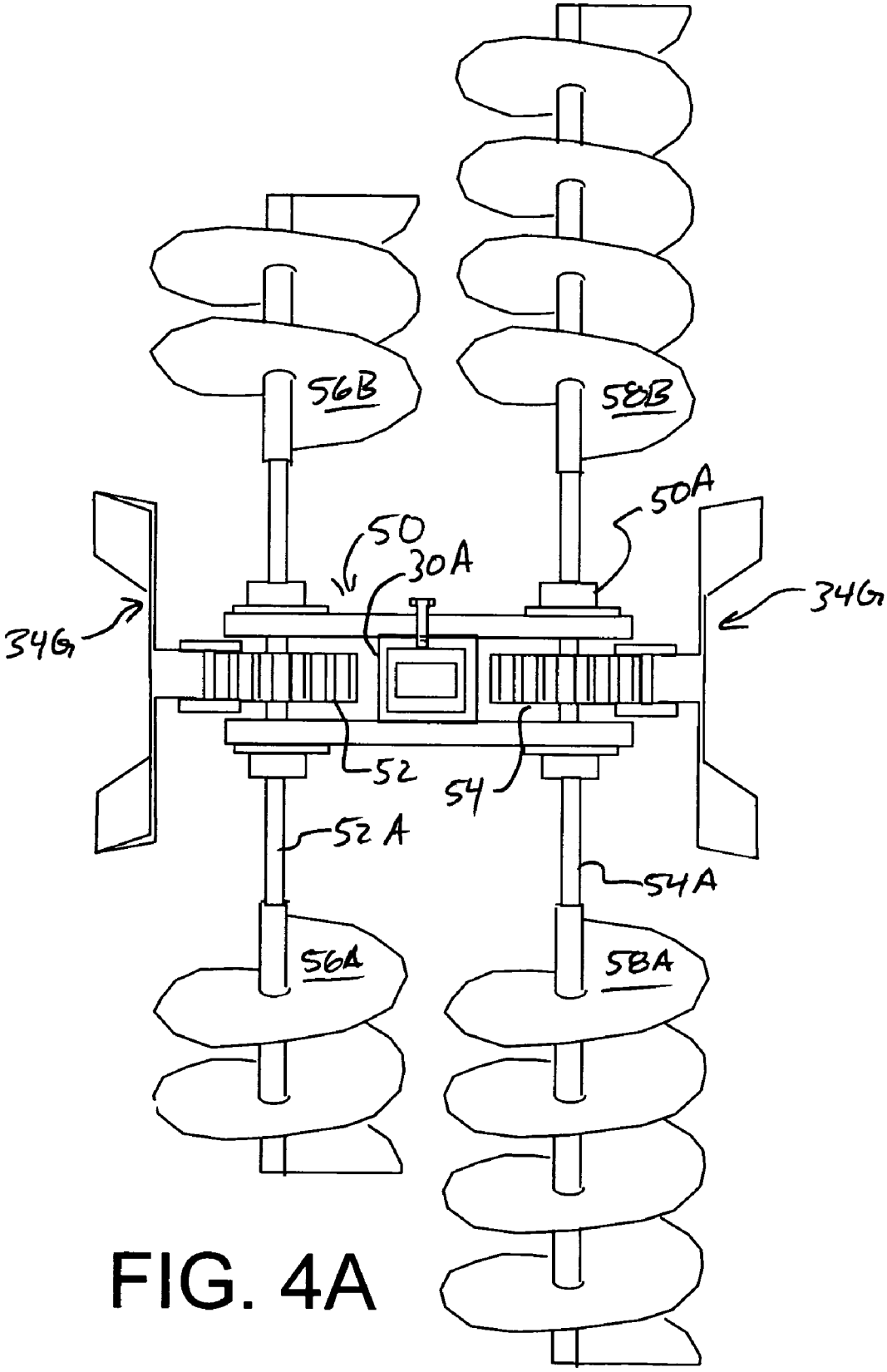
FIG. 4A is a detail top view of the auger assembly shown with the augers fully extended upon the auger shafts.

Auger assembly 50 can be best understood with reference to FIGS. 3, 4 and 4A. The purpose of auger assembly 50 is to push excavated soil away from an excavated trench. More particularly, auger assembly 50 is adapted to push soil far enough away from an excavated trench to substantially clear the wheels of loader 200. Auger assembly 50 is particularly useful in situations where a deep trench is excavated or a relatively wide moderately deep trench is excavated such that a considerable volume of soil is removed from the excavated trench. Auger assembly 50 is adjustably mounted to support assembly 30 and more particularly to sleeve member 30A. As can be best seen in FIG. 4, auger assembly 50 is mounted to digging chain support assembly 30 such that its position can be adjusted between a first upper position as shown in FIG. 3E and a second lower position as shown in FIG. 3F. The first upper position corresponds to a configuration useful for digging a relatively deep trench. This is especially true if one or more extension members 30D are added to digging chain support assembly 30. As can be best understood with reference to FIG. 4, auger assembly 50 includes a forward auger drive sprocket 52 located forward of digging chain support assembly 30 and a rear auger drive sprocket 54 located behind digging chain support assembly 30. Forward auger drive sprocket 52 engages the forward inside portion of digging chain 34. (Digging chain 34 is omitted in FIGS. 4 and 4A for clarity.) Forward auger drive sprocket 52 is carried by an auger shaft 52A which is suitable for receiving two removable forward augers 56A and 56B. Forward augers 56A and 56B turn as digging chain 34 runs past auger drive sprocket 52. In the same way, rear auger drive sprocket 54 is carried by an auger shaft 54A which is suitable for receiving two removable rear augers 58A and 58B. Auger shafts 52A and 52B are mounted to auger assembly 50 by bearings 50A. Augers 56A, 56B, 58A and 58B are removable and interchangeable in order to accommodate digging chain 34 operating in two directions. Augers 56A, 56B, 58A and 58B, as shown in FIG. 4, are arranged to push dirt away from a trench digging operation such as the one shown in FIG. 2. Direction arrows 56D1 and 56D2 illustrate the direction of rotation of augers 56A and 56B respectively. Direction arrows 56E1 and 56E2 illustrate the directions in which excavated dirt is transferred away from an excavated trench by augers 56A and 56B. Similarly, direction arrows 58D1 and 58D2 illustrate the direction of rotation of augers 58A and 58B respectively. Direction arrows 58E1 and 58E2 illustrate the directions in which excavated dirt from augers 56A and 56B and from an excavated trench is transferred away from an excavated trench by augers 58A and 58B. The configuration shown in FIG. 4 is intended to transfer dirt a sufficient distance away from a trench to permit the wheels of loader 200 to roll forward without rolling over a significant amount of excavated dirt. Augers 56A, 56B, 58A and 58B may be adjusted upon shafts 52A and 54A between a relatively narrowly spaced configuration as shown in FIG. 4 and a relatively widely spaced position as shown in FIG. 4A. The relatively wide configuration shown in FIG. 4A is intended to accommodate a digging chain having wide teeth for digging a relatively wide trench. Example wide toothed digging chain links 34G are shown in FIG. 4A. In FIG. 7C, trencher unit 10 is shown operating at a relatively shallow angle and in a direction that is reversed from that shown in FIG. 2. When operating in this mode, augers 56A and 56B can be removed while augers 58A and 58B are installed in a manner that is reversed from the arrangement shown in FIG. 4 thus pushing soil away from an excavated trench when the direction of rotation is opposite of that indicated by direction arrows 58D1 and 58D2 of FIG. 4.

It is preferable that the distance between auger drive sprockets 52 and 54 be not significantly less than 15 percent and not significantly more than 25 percent of the distance between chain drive sprocket 20 and idler wheel 32. If this ratio is significantly less than 15 percent, digging chain 34 will not sufficiently wrap around auger drive sprockets 52 and 54 to adequately engage them. Since digging chain 34 will always have some degree of slack, it may jump over auger drive sprockets 52 and 54 when the wrap angle is too shallow. Conversely, if auger drive sprockets 52 and 54 are spaced too far apart then the resulting wide path followed by digging chain 34 will increase the difficulty of excavating a curved trench. The applicant has found that the optimum ratio of chain drive sprocket and idler wheel spacing in relation to auger drive sprocket spacing is approximately 6 to 1.

Since attachment fitting 202 of loader 200 can be raised and lowered by its arms as well as tilted by a second pair of hydraulic cylinders as shown in FIG. 1, trencher unit 10 can be raised and lowered and tilted as well. Trencher unit 10 can be tilted between a substantially upright position as shown in FIG. 2 and a tilted position as shown in FIG. 6A.

Figure 6A:
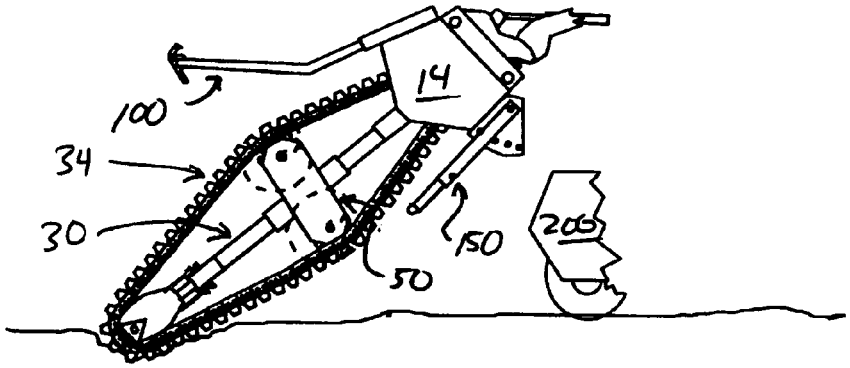
FIG. 6A is a side view of the trencher unit as it begins penetrating a working surface with the loader cut away for clarity.
Figure 6B:
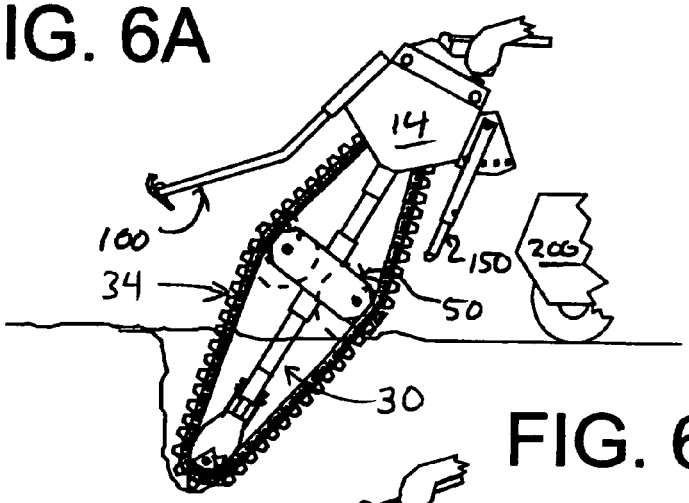
FIG. 6B is a side view of the trencher unit as it continues to penetrate a working surface.
Figure 6C:
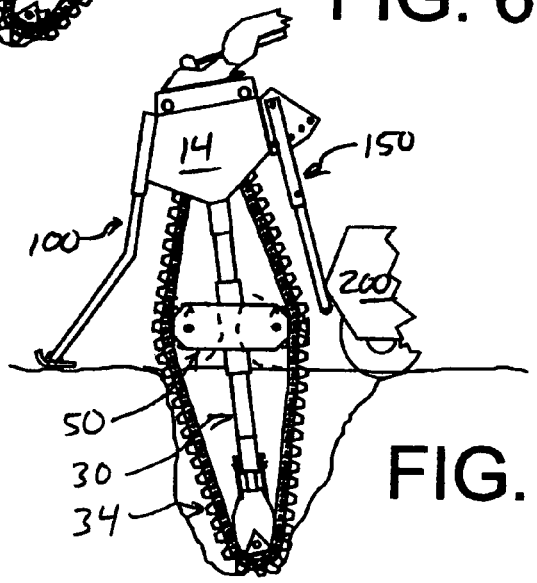
FIG. 6C is a side view of the trencher unit after penetrating a working surface prior to trenching in a forward direction with the loader moving forward as shown in FIG. 2.
Figure 7A:
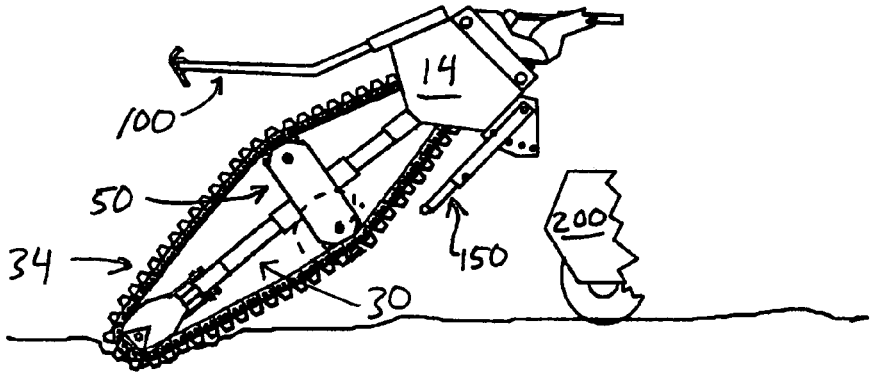
FIG. 7A is a side view of the trencher unit as it penetrates a working surface with the loader cut away for clarity.
Figure 7B:
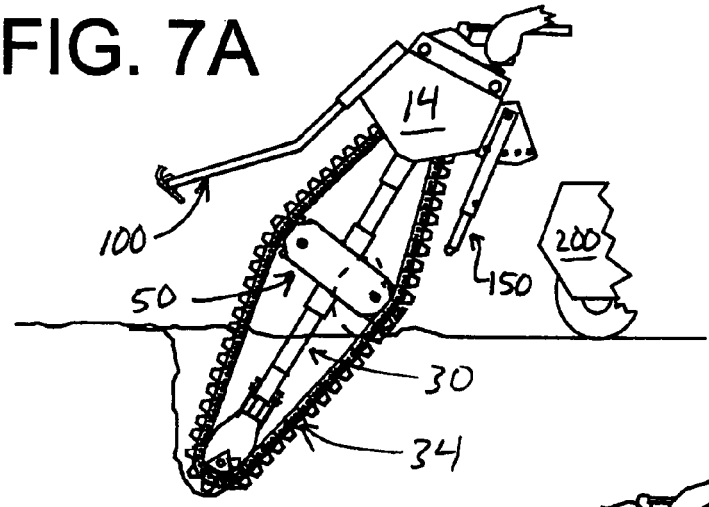
FIG. 7B is a side view of the trencher unit after penetrating a working surface.
Figure 7C:
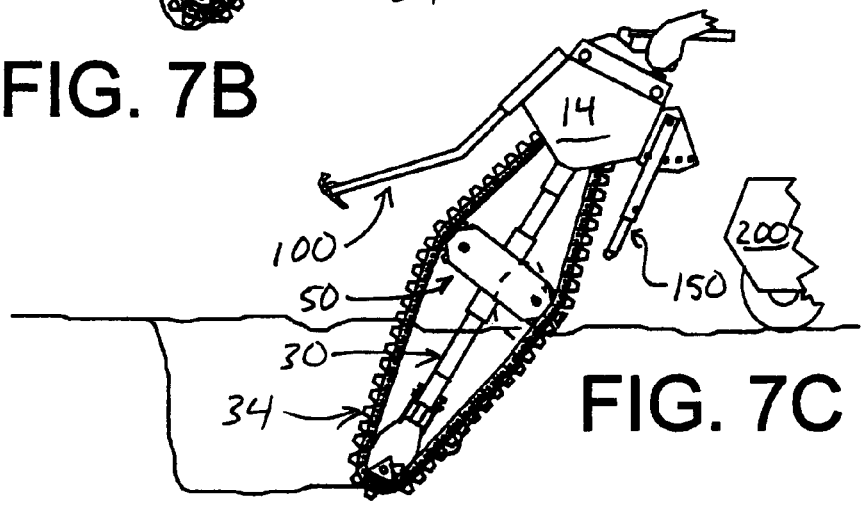
FIG. 7C is a side view of the trencher unit after entering a working surface as it trenches in a reverse direction with the loader moving in reverse.

Aside from being adjustable in various ways described above, trencher unit 10 may be operated in a forward mode as illustrated in FIGS. 2, and 6A–6C or a reverse mode as shown in FIGS. 7A–7C. When commencing a forward trench excavation operation, trencher unit 10 is preferably pivoted to a digging depth substantially as shown in FIGS. 6A–6C. After the position shown in FIG. 6C is accomplished, excavation proceeds as shown in FIG. 2. During a forward excavation operation as shown in FIGS. 6C and 2, skid plate 106 is generally in contact with the surface in front of the trench and brace assembly 150 is in contact with the front end of loader 200. During a forward digging operation, relatively deep trenches can be dug and since trencher unit 10 is in a relatively upright orientation, loader 200 may execute turns in order to dig curved sections of trench. It is preferable, when in the digging position shown is FIGS. 2 and 6C that digging chain support assembly 30 is tilted forward by a relatively small angle as shown in FIGS. 2 and 6C. This orients digging chain 34 such that the segment of digging chain 34 cutting the forward face of the trench is sloped to facilitate the removal of material from the excavated trench.

As noted above, the reverse mode of operating trencher unit 10 may be understood with reference to FIGS. 7A–7C. When commencing a reverse trench excavation operation, trencher unit 10 is preferably pivoted into a working surface to a digging depth substantially as shown in FIGS. 7A and 7B. After the position shown in FIG. 7B is accomplished, excavation may proceed as shown in FIG. 7C. During a reverse excavation operation, skid plate 106 is not in contact with the ground and brace assembly 150 is retracted. During a reverse digging operation, it is not necessary to mount augers to trailing auger shaft 52A. Either short or long augers may be mounted to auger shaft 54A if the operator wishes to move excavated soil away from the excavated trench. As noted above, when digging in a reverse direction, digging chain 34 must travel in a direction opposite of that shown by direction arrow B in FIG. 2 and any augers must be installed in a manner opposite of that shown in FIGS. 4 and 4A for augers 58A and 58B. Moreover, digging chains are generally directional, so digging chain 34 must generally be removed and reversed to accommodate a reversed digging direction.

Accordingly, the trencher unit described above is a highly versatile unit which can be used in a wide range of applications. The trencher unit is highly compact, simple and inexpensive in view of its considerable capabilities. Because it relies on popular and widely available loaders for power and movement, it does not need to include a carriage or a power source.

Because of these adjustable features, it is possible to operate trencher unit 10 within a wide range of positions and modes. Trencher 10 can operate at any angle between a shallow 45 degree angle shown in FIG. 7C and a substantially upright position as shown in FIG. 2. The direction of travel of digging chain 34 can be changed to support a forward direction or a reverse direction. Excavation of a trench can be conducted to the left or the right of the centered position as shown in FIGS. 5A–5C. Trencher unit 10 can be reconfigured to dig trenches ranging in width from a relatively narrow trench to a relatively wide width. A digging chain having links with relatively narrow teeth as shown in FIG. 3D may be replace by a digging chain having links with relatively wide teeth as shown in FIG. 4A. By adding extension members 30D and extending telescoping member 30B within sleeve member 30 of digging chain support assembly 30 as shown in FIG. 3, trencher unit 10 may be configured for digging at greater depths. Moreover, varying trench depths may be accommodated by shifting the position of auger assembly 50 an upper position shown in FIG. 3E and a lower position shown in FIG. 3F.

Because the digging chain of trencher unit 10 operates in a relatively upright position and in a forward direction because of dirt removing augers which clear excavated soil from a loader's path, an operator may dig curved or straight section of trench. Because the dirt removing augers may be adjustably located relative to trencher unit 10, because length of digging chain support assembly 30 may be adjusted as shown above and because digging chains of varying widths may be interchanged, trencher unit 10 may be used to dig trenches of varying depths and widths. Accordingly, it is possible to use trencher unit 10, in combination with a typical loader type vehicle, while operating that loader vehicle in a reverse moving fashion or in a more easily operable forward moving fashion to dig trenches of varying widths, depths and shapes.

It is to be understood that while certain forms of this invention have been illustrated and described, it is not limited thereto, except in so far as such limitations are included in the following claims and allowable equivalents thereof.

The invention claimed is:

1. A trencher unit for mounting to the attachment fitting of a loader of the type having arms for vertical motion and the attachment fitting pivotably mounted to the arms for pivoting movement and controls for moving the arms up and down and pivoting the attachment fitting to thereby control the vertical position and orientation of the attachment fitting, the trencher unit comprising:

(a) an attachment assembly for mounting to the attachment fitting of the loader, (b) a digging chain support frame having a proximate end and a distal end and fixed at the proximate end thereof to the attachment assembly, (c) a chain drive sprocket rotatably mounted to the digging chain support frame toward the proximate end thereof, (d) an idler wheel rotatably mounted to the digging chain support frame at the distal end thereof, (e) an endless digging chain looping around the drive sprocket and the idler wheel for excavating soil to make a trench, (f) a chain drive motor mounted to the digging chain support frame for turning the drive sprocket and the digging chain, and, (g) an auger assembly adjustably mounted to the digging chain support frame between the drive sprocket and the idler wheel for adjustment between an upper position and a lower position, the upper position and the lower position corresponding to a range of trench depths, the auger assembly including at least one auger drive sprocket for engaging the digging chain and at least one auger coupled to the at least one auger drive sprocket for pushing soil away from the trench as the trench is excavated, whereby an operator may control the vertical position and orientation of the trencher unit and bring the digging chain of the trencher unit into penetrating and digging contact with an earthen surface such that a trench may be excavated as the loader moves over the earthen surface as the auger of the auger assembly having been adjusted to a position corresponding to a desired trench depth pushes excavated soil away from the trench.

2. The trencher unit of claim 1, wherein:

the auger assembly includes at least two auger drive sprockets fixed to transverse auger shafts, the auger shafts rotatably mounted to the auger assembly and extending from both sides thereof, the auger drive sprockets engaging the digging chain on either side of the support frame and wherein each auger shaft is adapted for receiving an auger on both sides of the auger assembly.

3. The trencher unit of claim 1, wherein:

the auger assembly includes at least two auger drive sprockets fixed to transverse auger shafts, the auger shafts rotatably mounted to the auger assembly and extending from both sides thereof, the auger drive sprockets engaging the digging chain on either side of the support frame and wherein each auger shaft is adapted for receiving an auger on both sides of the auger assembly, each auger may be adjustably mounted to each auger shaft between a closely spaced position and a widely spaced position.

4. The trencher unit of claim 1, wherein, the digging chain support frame includes a sleeve member and a telescoping support member for carrying the idler wheel, the telescoping support member received by the sleeve member for adjustable movement of the telescoping support member and the idler wheel in relation to the chain drive sprocket between a first retracted position and a second extended position.

5. The trencher unit of claim 1, further comprising, a skid plate assembly mounted to the front of the digging chain support frame including a skid arm and a skid plate for contacting the ground in front of the digging chain support frame to limit undesired forward pivoting movement thereof.

6. The trencher unit of claim 1, further comprising, an adjustable brace assembly mounted behind the digging chain support frame including an extendible brace arm for providing a brace between digging chain support frame and the loader to limit pivoting movement of the digging chain support frame.

7. The trencher unit of claim 1, further comprising, (a) a skid plate assembly mounted to the front of the digging chain support frame including a skid arm and a skid plate for contacting the ground in front of the digging chain support frame to limit undesired forward pivoting movement thereof, and, (b) an adjustable brace assembly mounted behind the digging chain support frame including an extendible brace arm for providing a brace between digging chain support frame and the loader to limit pivoting movement of the digging chain support frame.

8. A trencher unit for mounting to the attachment fitting of a loader of the type having arms for vertical motion and the attachment fitting pivotably mounted to the arms for pivoting movement and controls for moving the arms up and down and pivoting the attachment fitting to thereby control the vertical position and orientation of the attachment fitting, the trencher unit comprising:

(a) an attachment assembly for mounting to the attachment fitting of the loader, (b) a digging chain support frame including a housing and a digging chain support assembly mounted to the housing, the digging chain support assembly including a sleeve member and a telescoping support member which is received by the sleeve member, (c) an idler wheel assembly including a rotatably mounted idler wheel mounted to the lower end of the telescoping support member and an adjustment mechanism for pushing the idler wheel assembly away from the sleeve member, (d) a chain drive sprocket fixed to a chain drive shaft, the chain drive shaft rotatably mounted to the housing, (e) a chain drive motor mechanically coupling the housing and the chain drive shaft for powering the chain drive sprocket, (f) an endless digging chain looping around the drive sprocket and the idler wheel for excavating soil to make a trench, and, (g) an auger assembly adjustably mounted to the digging chain support assembly between the drive sprocket and the idler wheel assembly for adjustment between an upper position and a lower position, the upper position and the lower position corresponding to a range of trench depths, the auger assembly including a first auger drive sprocket located in front of the chain support assembly and a second auger drive sprocket located behind the chain support assembly, the first and second drive sprockets for engaging the digging chain and for turning auger shafts that carry augers which are adapted for pusing soil away from a trench as the trench is excavated, whereby an operator may control the vertical position and orientation of the trencher unit and bring the digging chain of the trencher unit into penetrating and digging contact with an earthen work surface such that a trench may be excavated as the loader moves over the earthen surface as the augers of the auger assembly having been adjusted to a position corresponding to a desired trench depth push excavated soil across the earthen work surface and away from the trench.

9. The trencher unit of claim 8, wherein:

each auger may be adjustably mounted to each auger shaft between a narrowly spaced position and a widely spaced position.

10. The trencher unit of claim 8, wherein, the digging chain support assembly further comprises an end member received at the end of the sleeve member and at least one extension member which is interposed between the sleeve member and the end member in order to increase the length of the digging chain support assembly and wherein the adjustment mechanism is connected between the end member and the idler wheel assembly, and the telescoping support member is received by the sleeve member, the end member and the at least one extension member.

11. The trencher unit of claim 8, further comprising, a skid plate assembly mounted to the front of the digging chain support frame including a skid arm and a skid plate for contacting the ground in front of the digging chain support frame to limit undesired forward pivoting movement thereof.

12. The trencher unit of claim 8, further comprising, an adjustable brace assembly mounted behind the digging chain support frame including an extendible brace arm for providing a brace between digging chain support frame and the loader to limit pivoting movement of the digging chain support frame.

13. The trencher unit of claim 8, further comprising, (a) a skid plate assembly mounted to the front of the digging chain support frame including a skid arm and a skid plate for contacting the ground in front of the digging chain support frame to limit undesired forward pivoting movement thereof, and, (b) an adjustable brace assembly mounted behind the digging chain support frame including an extendible brace arm for providing a brace between digging chain support frame and the loader to limit pivoting movement of the digging chain support frame.

14. The trencher unit of claim 8, wherein, the digging chain support assembly further comprises an end member received the sleeve member and at least one extension member which is interposed between the sleeve member and the end member in order to increase the length of the digging chain support assembly and wherein the adjustment mechanism is connected between the end member and the idler wheel assembly, and the telescoping support member is received by the sleeve member, the end member and the at least one extension member, a skid plate assembly is mounted to the front of the digging chain support frame including a skid arm and a skid plate for contacting the ground in front of the digging chain support frame to limit undesired forward pivoting movement thereof, and, an adjustable brace assembly is mounted behind the digging chain support frame including an extendible brace arm for providing a brace between digging chain support frame and the loader to limit pivoting movement of the digging chain support frame.

15. A trencher unit for mounting to the attachment fitting of a loader of the type having arms for vertical motion and the attachment fitting pivotably mounted to the arms for pivoting movement and controls for moving the arms up and down and pivoting the attachment fitting to thereby control the vertical position and orientation of the attachment fitting, the trencher unit comprising:

(a) an attachment assembly for mounting to the attachment fitting of the loader, (b) a digging chain support frame having a proximate end and a distal end and fixed at the proximate end thereof to the attachment assembly, the digging chain support frame further including a telescoping support member, the telescoping support member for adjustable movement between a first retracted position and a second extended position, (c) a chain drive sprocket rotatably mounted to the digging chain support frame toward the proximate end thereof, (d) an idler wheel rotatably mounted to the telescoping support member of the digging chain support frame at the distal end thereof, the idler wheel adjustable between a frist retracted position when the telescoping support member is in the first retracted position and a second extended position when the telescoping support member is in the second extended position, (e) an endless digging chain looping around the drive sprocket and the idler wheel for excavating soil to make a trench, (f) a chain drive motor mounted to the digging chain support frame for turning the drive sprocket and the digging chain, and, (g) an auger assembly adjustably mounted to the digging chain support frame between the drive sprocket and the idler wheel for adjustment between an upper position and a lower position, the upper position and the lower position corresponding to a range of trench depths, the auger assembly including at least one auger drive sprocket for engaging the digging chain and at least one auger coupled to the at least one auger drive sprocket for pushing soil away from the trench as the trench is excavated.

16. A trencher unit for mounting to the attachment fitting of a loader of the type having arms for vertical motion and the attachment fitting pivotably mounted to the arms for pivoting movement and controls for moving the arms up and down and pivoting the attachment fitting to thereby control the vertical position and orientation of the attachment fitting, the trencher unit comprising:

(a) an attachment assembly for mounting to the attachment fitting of the loader.

(b) a digging chain support frame having a proximate end and a distal end and fixed at the proximate end thereof to the attachment assembly, (c) a skid plate assembly mounted to the front of the digging chain support frame including a skid arm and a skid plate for contacting the ground in front of the digging chain support frame to limit undesired forward pivoting movement thereof, (d) a chain drive sprocket rotatably mounted to the digging chain support frame toward the proximate end thereof, (e) an idler wheel rotatably mounted to the digging chain support frame at the distal end thereof (f) an endless digging chain looping around the drive sprocket and the idler wheel for excavating soil to make a trench, (g) a chain drive motor mounted to the digging chain support frame for turning the drive sprocket and the digging chain, and, (h) an auger assembly adjustably mounted to the digging chain support frame between the drive sprocket and the idler wheel for adjustment between an upper position and a lower position, the upper position and the lower position corresponding to a range of trench depths, the auger assembly including at least one auger drive sprocket for engaging the digging chain and at least one auger mechanically associated with the at least one auger drive sprocket for pushing soil away from the trench as the trench is excavated.

17. A trencher unit for mounting to the attachment fitting of a loader of the type having arms for vertical motion and the attachment fitting pivotably mounted to the arms for pivoting movement and controls for moving the arms up and down and pivoting the attachment fitting to thereby control the vertical position and orientation of the attachment fitting, the trencher unit comprising:

(a) an attachment assembly for mounting to the attachment fitting of the loader, (b) a digging chain support frame having a proximate end and a distal end and fixed at the proximate end thereof to the attachment assembly, (c) an adjustable brace assembly mounted behind the digging chain support frame including an extendible brace arm for providing a brace between digging chain support frame and the loader to limit pivoting movement of the digging chain support frame, (d) a chain drive sprocket rotatably mounted to the digging chain support frame toward the proximate end thereof, (e) an idler wheel rotatably mounted to the digging chain support frame at the distal end thereof, (f) an endless digging chain looping around the drive sprocket and the idler wheel for excavating soil to make a trench, (g) a chain drive motor mounted to the digging chain support frame for turning the drive sprocket and the digging chain, and, (h) an auger assembly adjustably mounted to the digging chain support frame between the drive sprocket and the idler wheel for adjustment between an upper position and a lower position, the upper position and the lower position corresponding to a range of trench depths, the auger assembly including at least one auger drive sprocket for engaging the digging chain and at least one auger mechanically associated with the at least one auger drive sprocket for pushing soil away from the trench as the trench is excavated.

18. A trencher unit for mounting to the attachment fitting of a loader of the type having arms for vertical motion and the attachment fitting pivotably mounted to the arms for pivoting movement and controls for moving the arms up and down and pivoting the attachment fitting to thereby control the vertical position and orientation of the attachment fitting, the trencher unit comprising:

(a) an attachment assembly for mounting to the attachment fitting of the loader, (b) a digging chain support frame having a proximate end and a distal end and fixed at the proximate end thereof to the attachment assembly, (c) a skid plate assembly mounted to the front of the digging chain support frame including a skid arm and a skid plate for contacting the ground in front of the digging chain support frame to limit undesired forward pivoting movement thereof, (d) an adjustable brace assembly mounted behind the digging chain support frame including an extendible brace arm for providing a brace between digging chain support frame and the loader to limit pivoting movement of the digging chain support frame, (e) a chain drive sprocket rotatably mounted to the digging chain support frame toward the proximate end thereof, (f) an idler wheel rotatably mounted to the digging chain support frame at the distal end thereof (g) an endless digging chain looping around the drive sprocket and the idler wheel for excavating soil to make a trench, (h) a chain drive motor mounted to the digging chain support frame for turning the drive sprocket and the digging chain, and, (i) an auger assembly adjustably mounted to the digging chain support frame between the drive sprocket and the idler wheel for adjustment between an upper position and a lower position, the upper position and the lower position corresponding to a range of trench depths, the auger assembly including at least one auger drive sprocket for engaging the digging chain and at least one auger mechanically associated with the at least one auger drive sprocket for pushing soil away from the trench as the trench is excavated.

* * * * *